US007127185B2

(12) United States Patent
Doty et al.

(10) Patent No.: US 7,127,185 B2
(45) Date of Patent: Oct. 24, 2006

(54) METHOD AND SYSTEM FOR COMPONENT REPLACEMENT BASED ON USE AND ERROR CORRELATION

(75) Inventors: Kenneth T. Doty, New Windsor, MD (US); Richard R. T. Carling, Webster, NY (US); Joseph J. Furno, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/922,356

(22) Filed: Aug. 20, 2004

(65) Prior Publication Data

US 2006/0039708 A1 Feb. 23, 2006

(51) Int. Cl.
*G03G 15/00* (2006.01)
*G03G 15/08* (2006.01)

(52) U.S. Cl. ..... 399/24; 399/27; 399/25

(58) Field of Classification Search ..... 399/24, 399/12, 25, 26, 27, 31, 111
See application file for complete search history.

(56) References Cited

U.S. PATENT DOCUMENTS

| | | | | |
|---|---|---|---|---|
| 5,331,579 | A * | 7/1994 | Maguire et al. | 703/2 |
| 6,718,285 | B1 | 4/2004 | Schwartz et al. | 702/184 |
| 6,944,408 | B1 * | 9/2005 | Holzner | 399/24 |
| 2003/0091352 | A1 * | 5/2003 | Carling et al. | 399/24 |
| 2004/0133593 | A1 * | 7/2004 | Pathak et al. | 707/103 R |

* cited by examiner

*Primary Examiner*—Hoang Ngo
(74) *Attorney, Agent, or Firm*—Justin D. Petruzzelli

(57) ABSTRACT

A method and system, for component replacement, which use a combination of replaceable component life tracking and error condition occurrence history to identify the need for component replacement.

20 Claims, 4 Drawing Sheets

METHOD AND SYSTEM FOR COMPONENT REPLACEMENT BASED ON USE AND ERROR CORRELATION

FIELD OF THE INVENTION

This invention relates to determining the replacement need for replaceable components, and more particularly to determination of replacement need for replaceable components based on a combination of usage and error correlation.

BACKGROUND OF THE INVENTION

Many systems have multiple components that wear at different rates and are replaced as they wear out in order to keep the whole system operating. In such systems the replacement of some or all worn out components may require specially trained service professionals such as field service engineers. Some systems may be provided with replaceable components that are replaceable by the system operator, thereby eliminating, or at least reducing the frequency of, the need to place a service call. This not only may reduce overall maintenance costs, but also reduces system down time by eliminating response time. In either case, replacement by a service call or by the operator, it is desirable to track the usage of replaceable components so as to accurately anticipate when they will fail. U.S. Pat. No. 6,718,285, issued in the name of Schwartz, et al., issued on Apr. 6, 2004, henceforth referred to as the Schwartz patent, discloses a replaceable component life tracking system and is hereby incorporated in this application by reference.

The Schwartz patent discloses a replaceable component life tracking system in which the usage of each replaceable component is tracked using a predetermined parameter. In a preferred embodiment, the system is a printing device and the usage of each replaceable component is tracked using the parameter corresponding to the number of pages printed. The life expectancy of each replaceable component is predetermined, and as the usage of each replaceable component is tracked, it is compared to the predetermined life expectancy, and the result periodically reported to the system operator via an operator interface. If any replaceable component usage reaches the life expectancy of that replaceable component, the operator is notified immediately, and instructed that the replaceable component ought to be replaced.

For most systems, for a number of reasons, a life tracking process of the type described above only provides an approximate forecast of the end of useful life of the replaceable components. For example, the wear rate of some or all of the replaceable components may not be constant with respect to the predetermined usage parameter. In the printing device embodiment, for example, all printed pages do not necessarily result in the same wear rate for all replaceable components. Furthermore, if the system is one that stops and starts between jobs, wear of the replaceable components may be occurring, but with no incrementing of the usage parameter. It is well known that in systems of this type the components wear faster when many shorter jobs are being run versus fewer longer jobs. Also, most replaceable components do not fail instantaneously due to wear, but rather tend to degrade gradually.

As a result of these observations, the decision of when to replace a component as its usage approaches or exceeds the life expectancy is left to the system operator. Furthermore, the operator may be willing to accept some degradation of system performance and therefore replace components less frequently thereby decreasing operating costs. In the printing device embodiment, image quality on the printed pages may degrade slowly and, if the images being printed are less demanding textual images versus pictorial images for example, or if the customers are less demanding, the operator may choose to continue to use a component well past the life forecasted by the life tracking process.

SUMMARY OF THE INVENTION

In light of the above, a need exists to augment end of life forecasting methods based on usage. The present invention uses error condition history to augment forecasting end of life of replaceable components based on usage. Each replaceable component is cross-referenced to each known error condition of the system with a probability factor, each probability factor being a previously determined probability that the replaceable component could be the cause of the occurrence of the error condition. The frequency of occurrence of each error condition is tracked and accumulated. For each replaceable component, in addition to usage, an error weighting is tracked, the error weighting being the sum, for all error conditions, of the accumulated occurrence frequency of each error condition multiplied by the replaceable component probability factor for that error condition. For each replaceable component a predetermined combination of usage and error weighting is continually compared with a predetermined threshold, and the result reported to the system operator on a periodic basis. Hence the operator's process of deciding when a replaceable component needs to be replaced is enhanced, compared to a decision based on usage alone.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
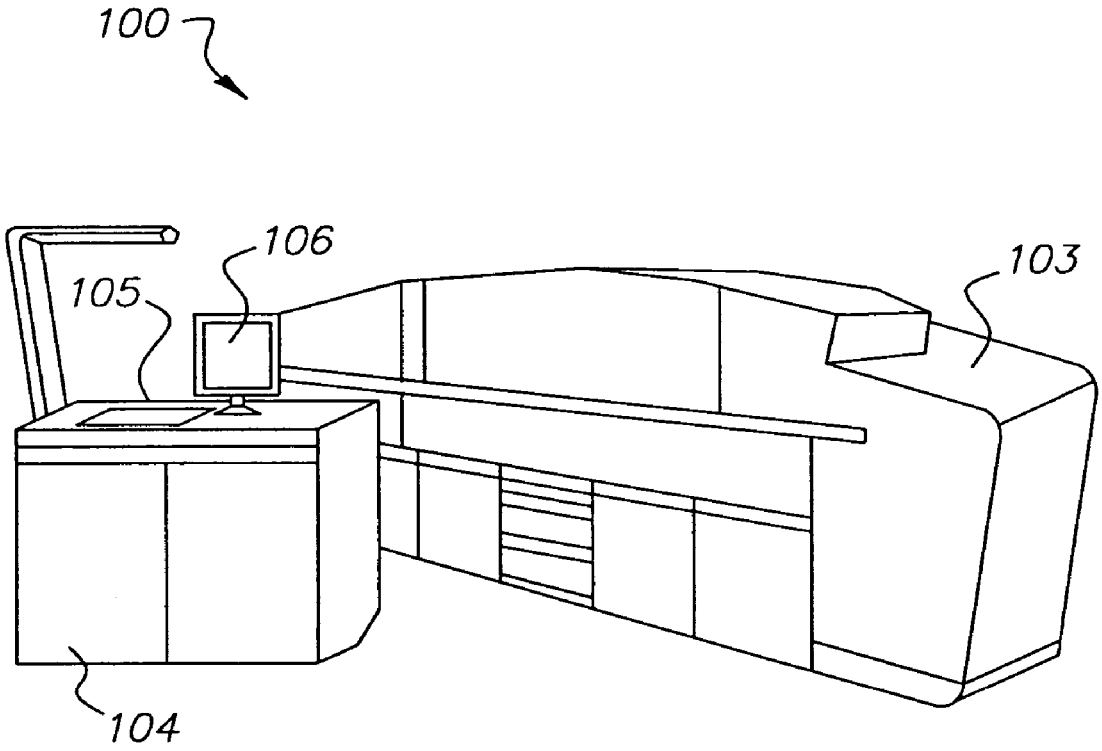
FIG. 1 is an illustration of a system including a digital printer, a digital front end, and a user interface that is suitable for use with a preferred embodiment of the invention.

FIG. 1 is an illustration of a system 100 suitable for use with the preferred embodiment of the present invention, and includes a digital printer 103, a Digital Front End (DFE) controller 104, and a Graphical User Interface (GUI) 106. Digital printer 103 is provided with Operator Replaceable Component (ORC) devices that enable a typical operator to perform the majority of maintenance on the system without requiring the services of a field engineer. The ORC devices are devices or combinations of devices which are grouped together as components within systems that become worn after periods of use and must be replaced. Specifically, the ORC devices are those components used within digital printing systems that wear with use and must be replaced. Digital printer 103, in the preferred embodiment, is a NexPress® 2100; however, the present invention pertains to systems in general, and digital printing systems in particular.

DFE controller 104 in the preferred embodiment is operatively associated with the digital printer 103, and includes a computational element 105 for controlling the digital printer. Computational element 105 contains a substantial number of processing components that perform a number of functions including raster image processing, database management, workflow management, job processing, ORC service management including tracking of ORC usage, etc. Graphical User Interface (GUI) 106 communicates with computational element 105 and with the operator. Tracking of ORC usage in this preferred embodiment is disclosed in the above referenced Schwartz patent. In the preferred embodiment, GUI 106 provides the operator with the ability to view the current status of ORC devices in the digital printer 103, and to thus perform maintenance in response to maintenance information provided on the graphical display of GUI 106, as well as to alerts that are provided from the DFE controller 104. It should be understood that while the preferred embodiment details a system 100 with a digital printer 103 having at least one computational element and another computational element associated with DFE controller 104, similar systems can be provided with more computational elements or fewer computational elements, and that these variations will be obvious to those skilled in the art. In general, virtually any interactive device can function as DFE controller 104, and specifically any Graphics User Interface (GUI) 106 can function in association with DFE controller 104 as employed by the present invention.

Figure 2:
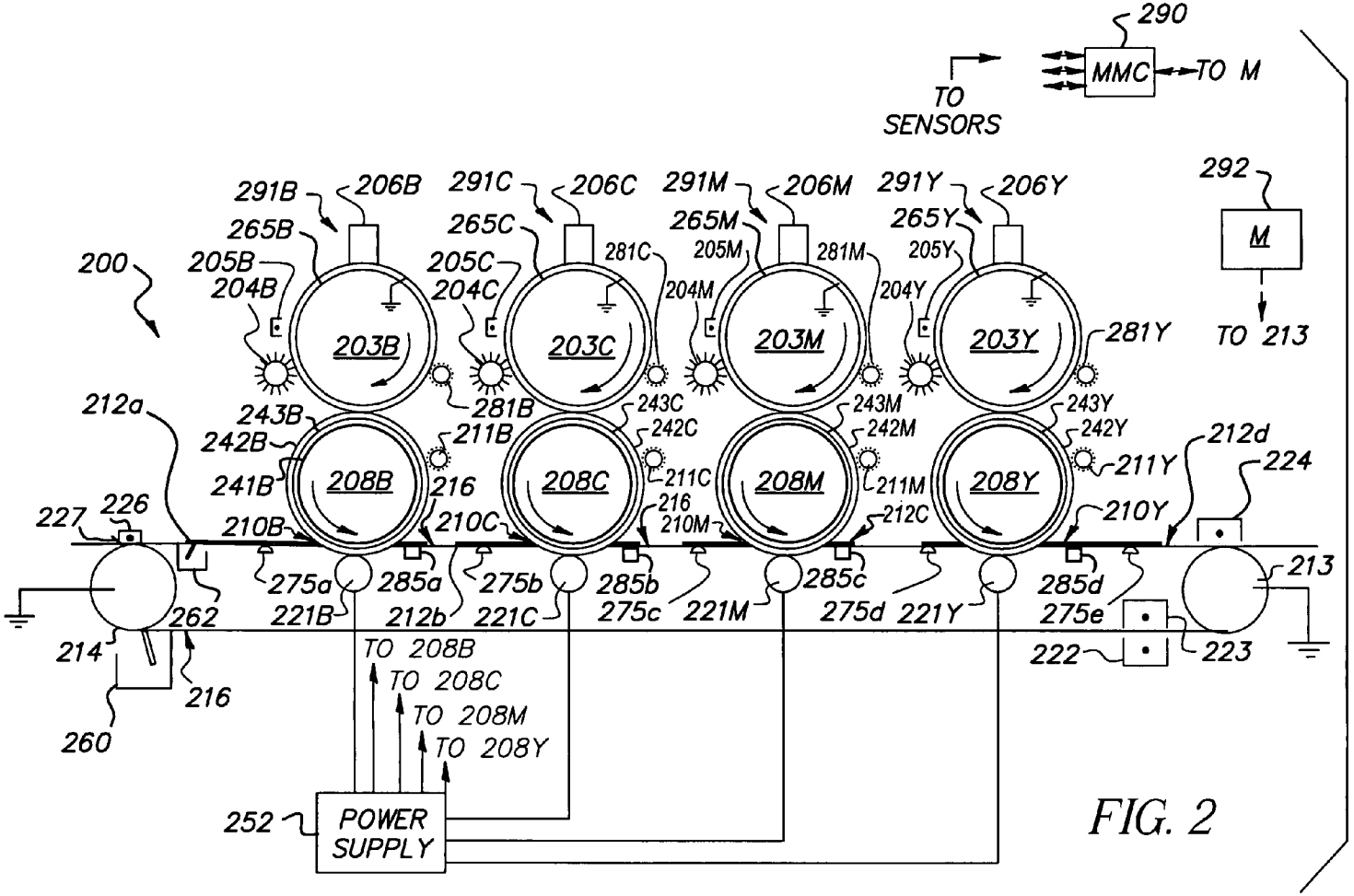
FIG. 2 is an illustration of a portion of the digital printer of FIG. 1 with the cabinetry removed showing a number of operator replaceable components.

Referring now to FIG. 2 of the accompanying drawings, a portion of the inside of the digital printer 103 is schematically illustrated, showing the image forming reproduction apparatus, designated generally by the numeral 200. The reproduction apparatus 200 is in the form of an electrophotographic reproduction apparatus, and more particularly a color reproduction apparatus, wherein color separation images are formed in each of four color print modules, and transferred in register to a receiver member as a receiver member is moved through the apparatus while supported on a paper transport web (PTW) 216. The apparatus 200 illustrates the image forming areas for a digital printer 103 having four color print modules, although the present invention is applicable to printers of all types, including printers that print with more or less than four colors.

The elements in FIG. 2 that are similar from print module to print module have similar reference numerals with a suffix of B, C, M and Y referring to the color print module for which it is associated; black, cyan, magenta and yellow, respectively. Each print module (291B, 291C, 291M, 291Y) is of similar construction. PTW 216, which may be in the form of an endless belt, operates with all the print modules 291B, 291C, 291M, 291Y and the receiver member is transported by PTW 216 from module to module. Four receiver members, or sheets, 212*a, b, c* and *d* are shown simultaneously receiving images from the different print modules, it being understood that each receiver member may receive one color image from each module and that in this example up to four color images can be received by each receiver member. The movement of the receiver member with the PTW 216 is such that each color image transferred to the receiver member at the transfer nip of each print module is a transfer that is registered with the previous color transfer so that a four-color image formed on the receiver member has the colors in registered superposed relationship on the receiver member. The receiver members are then serially detacked from the PTW 216 and sent to a fusing station (not shown) to fuse or fix the toner images to the receiver member. The PTW 216 is reconditioned for reuse by providing charge to both surfaces using, for example, opposed corona chargers 222, 223 which neutralize the charge on the two surfaces of the PTW 216. These chargers 222, 223 are operator replaceable components within the preferred embodiment and have an expected life span after which chargers 222, 223 will require replacement.

Each color print module includes a primary image-forming member (PIFM), for example a rotating drum 203B, C, M and Y, respectively. The drums rotate in the directions shown by the arrows and about their respective axes. Each PIFM 203B, C, M and Y has a photoconductive surface, upon which a pigmented marking particle image is formed. The PIFM 203B, C, M and Y have predictable lifetimes and constitute ORC devices. The photoconductive surface for each PIFM 203B, C, M and Y within the preferred embodiment is actually formed on outer sleeves 265B, C, M and Y, upon which the pigmented marking particle image is formed. These outer sleeves 265B, C, M and Y, have lifetimes that are predictable and therefore, are ORC devices. In order to form images, the outer surface of the PIFM is uniformly charged by a primary charger such as corona charging devices 205B, C, M and Y, respectively or other suitable charger such as roller chargers, brush chargers, etc. The corona charging devices 205B, C, M and Y each have a predictable lifetime and are ORC devices. The uniformly charged surface is exposed by suitable exposure mechanisms, such as, for example, a laser 206B, C, M and Y, or more preferably an LED or other electro-optical exposure device, or even an optical exposure device, to selectively alter the charge on the surface of the outer sleeves 265B, C, M and Y, of the PIFM 203B, C, M and Y to create an electrostatic latent image corresponding to an image to be reproduced. The electrostatic latent image is developed by application of charged pigmented marking particles to the latent image bearing photoconductive drum by a development station 281B, C, M and Y, respectively. The development station has a particular color of pigmented marking particles associated respectively therewith. Thus, each print module creates a series of different color marking particle images on the respective photoconductive drum. The development stations 281B, C, M and Y, have predictable lifetimes before they require replacement and are ORC devices. In lieu of a photoconductive drum, which is preferred, a photoconductive belt can be used.

Each marking particle image formed on a respective PIFM is transferred electrostatically to an intermediate transfer module (ITM) 208B, C, M and Y, respectively. The ITM 208B, C, M and Y have an expected lifetime and are, therefore, considered to be ORC devices. In the preferred embodiment, each ITM 208B, C, M and Y, has an outer sleeve 243B, C, M and Y that contains the surface to which the image is transferred from PIFM 203B, C, M and Y. These outer sleeves 243B, C, M and Y are considered ORC devices with predictable lifetimes. The PIFMs 203B, C, M and Y are each caused to rotate about their respective axes by frictional engagement with their respective ITM 208B, C, M and Y.

The arrows in the ITMs 208B, C, M and Y indicate the direction of their rotation. After transfer, the marking particle image is cleaned from the surface of the photoconductive drum by a suitable cleaning device 204B, C, M and Y, respectively to prepare the surface for reuse for forming subsequent toner images. Cleaning devices 204B, C, M and Y are considered ORC devices for the present invention.

Marking particle images are respectively formed on the surfaces 242B, C, M and Y for each of the outer sleeve 243B, C, M and Y for ITMs 208B, C, M and Y, and transferred to a receiving surface of a receiver member, which is fed into a nip between the intermediate image transfer member drum and a transfer backing roller (TBR) 221B, C, M and Y, respectively. The TBRs 221B, C, M and Y have predictable lifetimes and are considered to be ORC devices for the invention. Each TBR 221B, C, M and Y, is suitably electrically biased by a constant current power supply 252 to induce the charged toner particle image to electrostatically transfer to a receiver member. Although a resistive blanket is preferred for TBR 2211B, C, M and Y, the TBR 221B, C, M and Y can also be formed from a conductive roller made of aluminum or other metal. The receiver member is fed from a suitable receiver member supply (not shown) and is suitably "tacked" to the PTW 216 and moves serially into each of the nips 210B, C, M and Y where it receives the respective marking particle image in a suitable registered relationship to form a composite multicolor image. As is well known, the colored pigments can overlie one another to form areas of colors different from that of the pigments.

The receiver member exits the last nip and is transported by a suitable transport mechanism (not shown) to a fuser where the marking particle image is fixed to the receiver member by application of heat and/or pressure. A detack charger 224 may be provided to deposit a neutralizing charge on the receiver member to facilitate separation of the receiver member from the PTW 216. The detack charger 224 is another component that is considered to be an ORC device for the invention. The receiver member with the fixed marking particle image is then transported to a remote location for operator retrieval. The respective ITMs 208B, C, M and Y are each cleaned by a respective cleaning device 211B, C, M and Y to prepare it for reuse. Cleaning devices 211B, C, M and Y are considered by the invention to be ORC devices having lifetimes that can be predicted.

In feeding a receiver member onto PTW 216, charge may be provided on the receiver member by charger 226 to electrostatically attract the receiver member and "tack" it to the PTW 216. A blade 227 associated with the charger 226 may be provided to press the receiver member onto the belt and remove any air entrained between the receiver member and the PTW. The PTW 216, the charger 226 and the blade 227 are considered ORC devices.

The endless transport web (PTW) 216 is entrained about a plurality of support members. For example, as shown in FIG. 2, the plurality of support members are rollers 213, 214, with preferably roller 213 being driven as shown by motor 292 to drive the PTW. Support structures 275*a, b, c, d* and *e* are provided before entrance and after exit locations of each transfer nip to engage the belt on the backside and alter the straight line path of the belt to provide for wrap of the belt about each respective ITM. This wrap allows for a reduced pre-nip ionization and for a post-nip ionization which is controlled by the post-nip wrap. The nip is where the pressure roller contacts the backside of the PTW or where no pressure roller is used, where the electrical field is substantially applied. However, the image transfer region of the nip is a smaller region than the total wrap. Pressure applied by the transfer backing rollers (TBRs) 221B, C, M and Y is upon the backside of the belt 216 and forces the surface of the compliant ITM to conform to the contour of the receiver member during transfer. The TBRs 221B, C, M and Y may be replaced by corona chargers, biased blades or biased brushes, each of which would be considered by the invention to be an ORC device. Substantial pressure is provided in the transfer nip to realize the benefits of the compliant intermediate transfer member which are a conformation of the toned image to the receiver member and image content on both a microscopic and macroscopic scale. The pressure may be supplied solely by the transfer biasing mechanism or additional pressure applied by another member such as a roller, shoe, blade or brush, all of which are ORC devices for the present invention.

The receiver members utilized with the reproduction apparatus 200 can vary substantially. For example, they can be thin or thick paper stock (coated or uncoated) or transparency stock. As the thickness and/or resistivity of the receiver member stock varies, the resulting change in impedance affects the electric field used in the nips 210B, C, M, Y to urge transfer of the marking particles to the receiver members. Moreover, a variation in relative humidity will vary the conductivity of a paper receiver member, which also affects the impedance and hence changes the transfer field. Such humidity variations can affect the expected lifetime of ORC devices.

Appropriate sensors (not shown) of any well known type, such as mechanical, electrical, or optical sensors for example, are utilized in the reproduction apparatus 200 to provide control signals for the apparatus. Such sensors are located along the receiver member travel path between the receiver member supply, through the various nips, to the fuser. Further sensors are associated with the primary image forming member photoconductive drums 203, the intermediate image transfer member drums 208, the transfer backing members 221, and the various image processing stations. As such, the sensors detect the location of a receiver member in its travel path, the position of the primary image forming member photoconductive drums 203 in relation to the image forming processing stations, and respectively produce appropriate signals indicative thereof.

Sensors on the primary image forming member photoconductive drums 203 measure the initial surface voltage, $V_{zero}$, produced by the primary corona charging devices 205, and the surface voltage, $E_{zero}$, after exposure by the exposure mechanisms 206. Additional sensors located along the receiver member travel path measure the density of marking particle process control patches developed on the primary image forming member photoconductive drums 203 by development stations 281, and transferred via the intermediate image transfer member drums 208, directly to the paper transport web 216.

All sensor signals are fed as input information to Main Machine Control (MMC) unit 290, which contains a computational element, and communicates with DFE controller 104. Based on such sensor signals, the MMC unit 290 produces signals to control the timing of the various electrostatographic process stations for carrying out the reproduction process and to control drive by motor 292 of the various drums and belts. The MMC unit 290 also maintains image quality within specification using feedback process control based on the density of marking particle process control patches described above. The production of control programs for a number of commercially available microprocessors, which are suitable for use with the MMC, is a conventional skill well understood in the art.

All operating parameters monitored by the above described sensors are expected to remain within certain limits for normal operation of digital printer 103. Any operating parameter value being outside normal operating limits constitutes an error condition. All possible error conditions are predetermined, assigned an error code, and stored in memory in MMC unit 290. If MMC unit 290 detects, from any sensor input signals, an error condition, it records the error code and sends the error code to the DFE controller 104. Each ORC device in digital printer 103 is known to relate to specific error conditions, and is cross-referenced to each error condition with a probability factor, which is a predetermined probability that the ORC device could cause the error condition. The probability factor is based on empirical knowledge of each ORC device, and can range from zero for an ORC/error condition where the ORC has no relationship to the error condition, to close to 100% for an ORC/error condition where a strong relationship exists between the ORC and the error condition. A cross-reference data table of ORC/error condition probability factors is stored in the DFE controller 104.

The following is an example of an error condition related to development stations 281. Development stations 281 contain developer having a mixture of pigmented marking particles and magnetic carrier particles. The pigmented marking particles become electrostatically charged by triboelectric interaction with the carrier particles. The charged marking particles are attracted to the electrostatic latent image that was formed on the photoconductive surface of sleeves 265 of the primary image-forming members 203, thereby developing the latent image into a visible image. As the developer ages due to printing, its ability to develop marking particles onto the photoconductive surface of sleeves 265 of the primary image-forming members 203 decreases. In order to maintain consistent marking particle density levels, the MMC 290 unit must increase various process control parameters and power supply voltages to compensate and to promote increased development of marking particles to the sleeves 265 of the primary image-forming members 203. As the developer continues to age and process parameters and voltages continue to elevate, they will eventually hit their maximum levels and an error condition will be occur. As the condition worsens, multiple voltages will hit there limits, which will cause a more severe error condition, which could then lead to the stopping of the digital printer 103.

The following is an example of an error condition related to the PIFM's 203. Periodically, the MMC unit 290 will execute a calibration routine known as Auto-Process Setup, which is responsible for determining the characteristics of the PIFM's 203, calculating process control starting points, and adjusting the process densities to their correct density aim values. During the first phase of this calibration cycle, exposure readings are taken to determine the speed and toe of the PIFM's 203. These imaging member parameters are then used to calculate the process control starting points, which are then checked against various minimum and maximum limits. If these limits are exceeded, the MMC unit 290 will flag an error condition.

The DFE controller 104 tracks the frequency of occurrence of each error condition, checks the cross-reference data table of ORC/error condition probability factors, and, for each ORC device, computes an error weighting, which is the result of multiplying each probability factor for each error condition times the frequency of occurrence of each error condition. For each ORC device, the DFE controller 104 tracks the error weighting described above and the accumulated life as described in the above referenced Schwartz patent, compares a predetermined combination of ORC error weighting and ORC accumulated life to a predetermined threshold, and periodically reports the results to the operator via the GUI 106. Any time the threshold is met for any ORC device, DFE controller 104 immediately alerts the operator via GUI 106 and suggests that the ORC device be replaced.

Figure 3A:
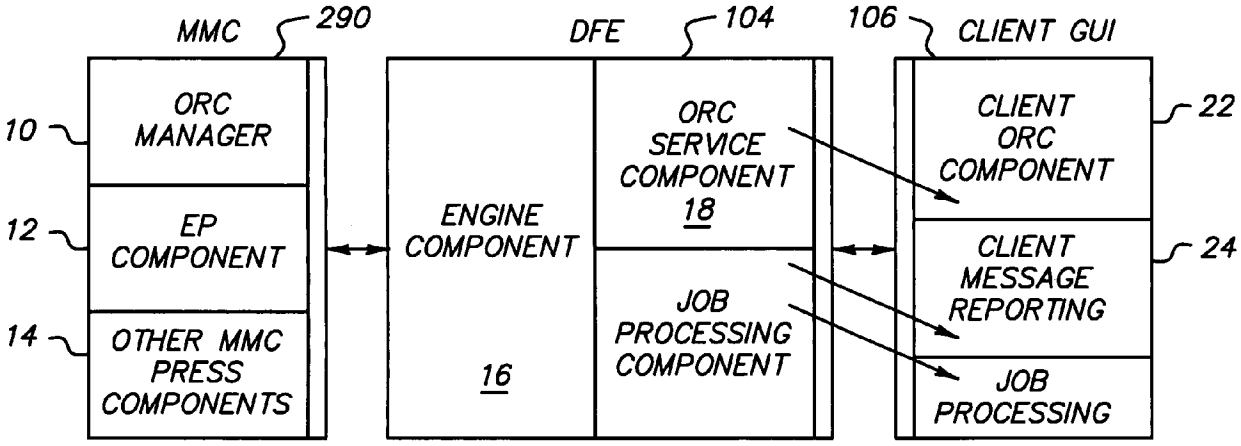
FIG. 3*a* is a basic high-level block diagram illustrating the pertinent control components of the digital printer, digital front end, and graphical user interface for the system of FIG. 1.

FIG. 3*a* is a block diagram illustrating the relationship between the MMC 290, the DFE controller 104, and the GUI 106. The MMC 290, DFE 104, and GUI 106 are each composed of a substantial number of signal processing components, but only those pertinent to the preferred embodiment of the present invention are illustrated. In the MMC 290 the EP component 12 represents the collection of sensors in the electrophotographic reproduction apparatus 200 described above, and the ORC Manager 10 is the component responsible for maintaining ORC data, tracking ORC life, and detecting and sending error conditions to the DFE controller 104. In the DFE controller 104, the Engine component 16 is responsible for communicating with the EP component 12 and routing the communications to the ORC Service component 18, which is responsible for all ORC service functions. In the GUI 106, the Client ORC 22 component is responsible for displaying ORC database tables, and the Client Message Reporting 24 component reports messages to the operator.

Figure 3B:
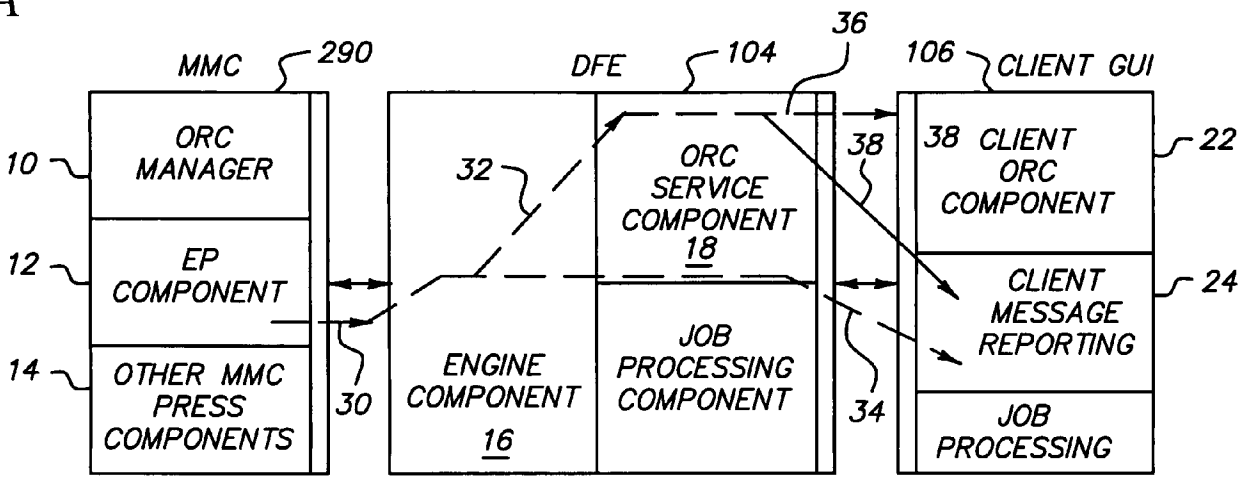
FIG. 3*b* is the block diagram of FIG. 3*a* with arrows showing the information processing flow between control components when an error condition is detected.

FIG. 3*b* illustrates, with a series of arrows, the signal processing flow between components when an error condition is detected by the MMC 290. The first step, arrow 30, is sending of the error condition to the DFE Engine component 16. The DFE Engine component 16 forwards the error condition to the ORC Service component 18, arrow 32, and to the Client Message Reporting component 24, arrow 34. The ORC Service component 18 checks the error threshold database table for applicable ORCs and sends any expired ORCs (based on exceeding threshold) to the ORC Client component 22, arrow 36, and to the Client Message Reporting component 24, arrow 38.

Figure 4:
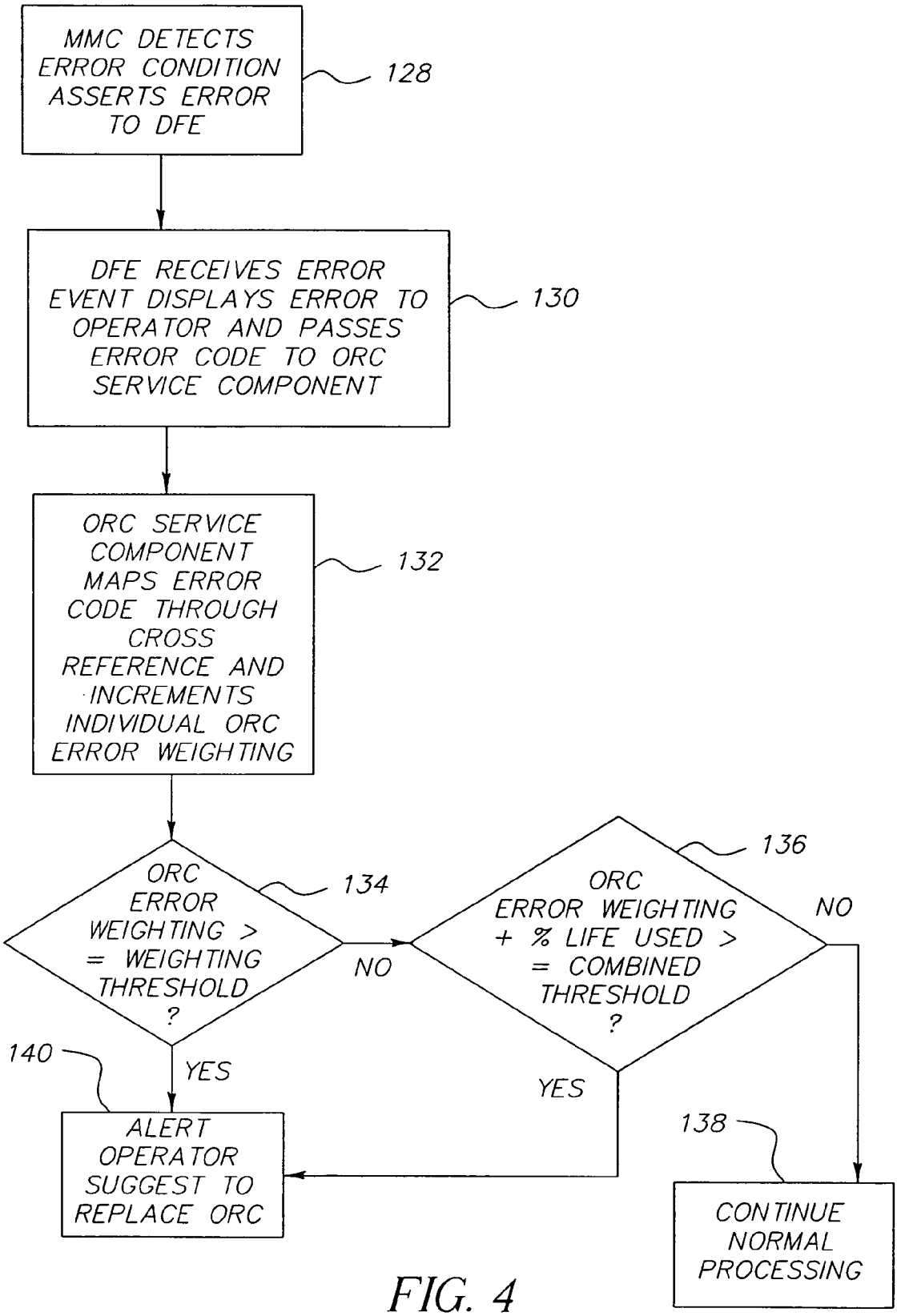
FIG. 4 is a basic high-level flow chart of the process of the invention.

FIG. 4 is a flow chart of the signal processing described above. In the embodiment of FIG. 4, the MMC 290 detects an error and asserts the error to the DFE control 104 (step 128). The DFE controller 104 passes the appropriate error code to the ORC Service Component 18 (step 130). Where it is mapped (step 132) with the predetermined combination of ORC error weighting and ORC accumulated life is embodied in the two decision points 134 and 136. The ORC error weighting is first compared to an error weighting threshold. If the error weighting threshold is met or exceeded, the operator is alerted (step 140), and it is suggested to replace the ORC. If the error weighting threshold is not met, the sum of ORC error weighting plus the accumulated life as a % of the life expectancy is compared to a combined threshold. If the combined threshold is met or exceeded, the operator is alerted (step 140) and it is suggested to replace the ORC. If the combined threshold is not met, normal processing is continued (step 138). The values of the ORC weighting threshold and the combined threshold in FIG. 3 are adjustable for different types of customer environments and job flows.

The invention has been described in detail with particular reference to certain preferred embodiments thereof, but it will be understood that variations and modifications can be effected within the spirit and scope of the invention.

What is claimed is:

1. In a system with operator replaceable component devices and identifiable error conditions, a method of determining a replacement need for each operator replaceable component device, said method comprising the steps of:

tracking a system use using a predetermined parameter;

providing a predetermined life expectancy for each said operator replaceable component device, in terms of said predetermined parameter;

tracking an accumulated life for each said operator replaceable component device, using said predetermined parameter;

tracking an occurrence frequency of each identifiable error condition;

cross-referencing each said operator replaceable component device to each said error condition with a probability factor, each said probability factor being a predetermined probability, expressed as a %, that said replaceable component could contribute to the cause of said error condition;

for each said operator replaceable component device, tracking an error weighting, said error weighting being the sum, for all said error conditions, of the result of multiplying each said probability factor for each said error condition times said occurrence frequency for each said error condition;

for each said operator replaceable component device, comparing a predetermined combination of said accumulated life and said error weighting with a predetermined threshold; and reporting to the system operator the result of the comparing step, for all said operator replaceable component devices, on a periodic basis, said periodic basis being a predetermined amount of said system use.

2. The method of claim 1, further comprising the step of notifying the system operator as soon as said predetermined combination meets or exceeds said threshold for any one of said operator replaceable component devices.

3. The method of claim 2, wherein the step of notifying further includes determining if said operator replaceable component device, for which said predetermined combination meets or exceeds said threshold, was replaced and, if said operator replaceable component device was replaced, re-setting said accumulated life and said error weighting of said operator replaceable component device to zero.

4. The method of claim 1, wherein said predetermined combination is the sum of (said accumulated life)(100)/(said life expectancy) plus said error weighting.

5. The method of claim 4, further comprising the step of notifying the system operator as soon as said predetermined combination meets or exceeds said threshold for any one of said operator replaceable component devices.

6. The method of claim 5, wherein the step of notifying the system operator further includes determining if said operator replaceable component device, for which said predetermined combination meets or exceeds said threshold, was replaced and, if said operator replaceable component device was replaced, was said accumulated life and said error weighting of said operator replaceable component device reset to zero.

7. The method of claim 6, wherein when said system is a printing device, said predetermined parameter is the number of pages printed.

8. The method of claim 7, wherein said predetermined parameter further includes a categorization of pages printed.

9. The method of claim 8, wherein said predetermined parameter further includes the size of pages printed.

10. The method of claim 8, wherein said predetermined parameter further includes a color related parameter.

11. A system with operator enabled maintenance and identifiable error conditions, said system comprising:

a plurality of operator replaceable component (ORC) device, each said ORC devices having an expected life span using a predetermined parameter;

a computational element having stored therein a data table cross-referencing, with a probability factor, each said ORC device to each identifiable error condition, each said probability factor being a predetermined probability, expressed as a %, that said ORC device could contribute to the cause of said error condition;

a use mechanism coupled to said computational element and to each said ORC device, said use mechanism tracking a system use and, for each said ORC device, tracking an ORC device use, using said predetermined parameter;

an error detection mechanism coupled to said computational element and to each said ORC device, said error detection mechanism tracking: 1) an occurrence frequency of each said error condition, and 2) an ORC device error weighting, said ORC error weighting being the sum, for all said error conditions, of the result of multiplying each said probability factor times said occurrence frequency for each said error condition;

a comparison mechanism coupled to said computational element and to each said ORC device, said comparison mechanism comparing to a predetermined threshold, for each said ORC, a predetermined combination of said ORC use and said ORC error weighting;

a user interface including a display mechanism and a graphical user interface; and a reporting mechanism, responsive to said comparison mechanism, providing, on a periodic basis, a report to the system operator via said user interface, said periodic basis being a predetermined amount of said system use.

12. The system of claim 11, wherein said reporting mechanism reports to the system operator as soon as said predetermined combination, for any one of said ORC devices, meets or exceeds said predetermined threshold.

13. The system of claim 12, wherein said use mechanism further determines if said ORC device, for which said predetermined combination meets or exceeds said predetermined threshold, was replaced, and, if said ORC device was replaced, was said ORC use and said ORC error weighting of said ORC device reset to zero.

14. The system of claim 11, wherein said predetermined combination is the sum of (ORC device use)(100)/(said life expectancy) plus said error weighting.

15. The system of claim 14, wherein said reporting mechanism reports to the system operator as soon as said predetermined combination, for any one of said ORC devices, meets or exceeds said predetermined threshold.

16. The system of claim 15, wherein said use mechanism further determines if said ORC device, for which said predetermined combination meets or exceeds said predetermined threshold, was replaced, and, if said ORC device was replaced, was said ORC use and said ORC error weighting of said ORC device reset to zero.

17. The system of claim 16, wherein when said system is a printing device, said predetermined parameter is the number of pages printed.

18. The system of claim 17, wherein said predetermined parameter further includes a categorization of pages printed.

19. The system of claim 18, wherein said predetermined parameter further includes the size of pages printed.

20. The system of claim 18, wherein said predetermined parameter further includes a color related parameter.

* * * * *